US005135425A

United States Patent [19]

Andrews et al.

[11] Patent Number: 5,135,425

[45] Date of Patent: Aug. 4, 1992

[54] MAGNETIC SPINNER TOY

[76] Inventors: Melvin R. Andrews, 28241 Yvette La., Corvallis, Oreg. 97330; Roger W. Andrews, 2461 Riverview St., Eugene, Oreg. 97403

[21] Appl. No.: 560,510

[22] Filed: Jul. 19, 1990

Related U.S. Application Data

[63] Continuation of Ser. No. 333,473, Apr. 4, 1989, abandoned.

[51] Int. Cl.[5] ..... A63H 33/26

[52] U.S. Cl. ..... 446/133; 335/306

[58] Field of Search ..... 446/129, 131-135, 446/484; 335/306, 302; 74/210; 384/446

[56] References Cited

U.S. PATENT DOCUMENTS

| | | | |
|---|---|---|---|
| 2,167,641 | 8/1939 | Dewan | 74/210 |
| 3,233,950 | 2/1966 | Baermann | 335/306 X |
| 3,550,316 | 12/1970 | MacPherson | 446/133 |
| 3,550,936 | 12/1970 | Puttick | 446/129 X |
| 3,817,518 | 6/1974 | Routson | 446/133 X |
| 3,908,307 | 9/1975 | Jacobson | 446/133 |
| 4,673,369 | 6/1987 | Di Pietro | 446/133 |
| 4,728,871 | 3/1988 | Andrews | 446/484 X |
| 4,753,623 | 6/1988 | Krut | 446/133 |

FOREIGN PATENT DOCUMENTS

| | | | |
|---|---|---|---|
| 1278328 | 6/1972 | United Kingdom | 446/133 |

*Primary Examiner*—Mickey Yu

*Attorney, Agent, or Firm*—Olson & Olson

[57] ABSTRACT

A magnetic spinner toy includes a plurality of spinner bodies mounted one adjacent another on a support base for independent rotation. A plurality of permanent spinner magnets are mounted on each spinner body at circumferentially spaced positions for rotation closely adjacent the spinner magnets of the adjacent spinner body. The magnetic poles of the confronting surfaces of the spinner magnets of adjacent spinner bodies are either of like polarity, whereby to repel each other, or of unlike polarity, whereby they attract each other. A pair of permanent levitating magnets are mounted one on each spinner body and the other on the support base with the confronting faces of the pair being of the same polarity, whereby to repel each other and thus maintain the spinner body spaced from the support base to eliminate frictional engagement between them. A battery-operated electromagnetic drive mechanism may be associated with at least one spinner body for actuation by movement of the spinner magnets of said spinner body to move said spinner body by magnetic repulsion, whereby to extend the operating time of the magnetic spinner toy.

8 Claims, 1 Drawing Sheet

MAGNETIC SPINNER TOY

This application is a continuation of application Ser. No. 07/333,473, filed Apr. 4, 1989, now abandoned.

BACKGROUND OF THE INVENTION

This invention relates to spinner type toys, and more particularly to a spinner type toy that operates by magnetic repulsion or attraction.

Spinner type toys that utilize magnetic repulsion are exemplified by U.S. Pat. Nos. 3,783,550 and 4,728,871. In these patents the spinner type toys receive energy from small voltage dry cell batteries and give the intriguing impression of perpetual motion, since they continue to operate for several weeks.

The spinner type toy of this invention differs from the foregoing patents in that the rotation of one magnetic spinner unit, whether initiated manually or by battery power, effects rotation of one or more additional magnetic spinner units.

SUMMARY OF THE INVENTION

The magnetic spinner toy of this invention utilizes at least two spinner units mounted adjacent to each other with each carrying a plurality of circumferentially spaced permanent magnets arranged to pass closely adjacent the magnets of an adjacent spinner unit and with the magnets arranged to present like or unlike magnetic poles to each other as they pass, whereby they function to repel or attract each other and thus cause one of them to induce motion in the other.

It is the principal objective of this invention to provide a magnetic spinner toy of the class described which offers to a viewer the interesting phenomenon of causing rotation of a spinner unit by initiating rotation of another spinner unit spaced therefrom.

Another objective of this invention is to provide a magnetic spinner toy of the class described which offers to a viewer the opportunity to speculate how long a time the spinner assembly will continue to operate after being set in motion manually.

Still another objective of this invention is the provision of a magnetic spinner toy of the class described which may be operated by a battery-activated power drive circuit.

A further objective of this invention is to provide a magnetic spinner toy of the class described which may be configured in a wide range of assembly shapes, sizes and numbers of spinners.

A still further objective of this invention is the provision of a magnetic spinner toy of the class described which includes a permanent magnet levitator arranged for supporting the spinner assemblies spaced apart from an underlying supporting base.

The foregoing and other objects and advantages of this invention will appear from the following detailed description, taken in connection with the accompanying drawings of preferred embodiments.

DESCRIPTION OF THE PREFERRED EMBODIMENTS

Figure 1:
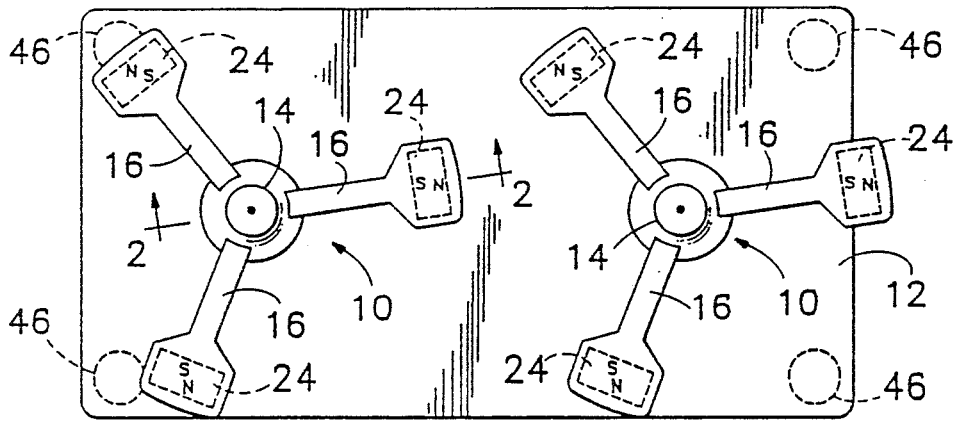
FIG. 1 is a plan view of a magnetic spinner toy embodying the features of this invention.

Referring primarily to FIG. 1 of the drawings, the magnetic spinner toy illustrated includes a pair of spinner units 10, 10 supported upon an underlying wood or other non-magnetic support base 12 in closely spaced apart positions for independent rotation.

Figure 2:
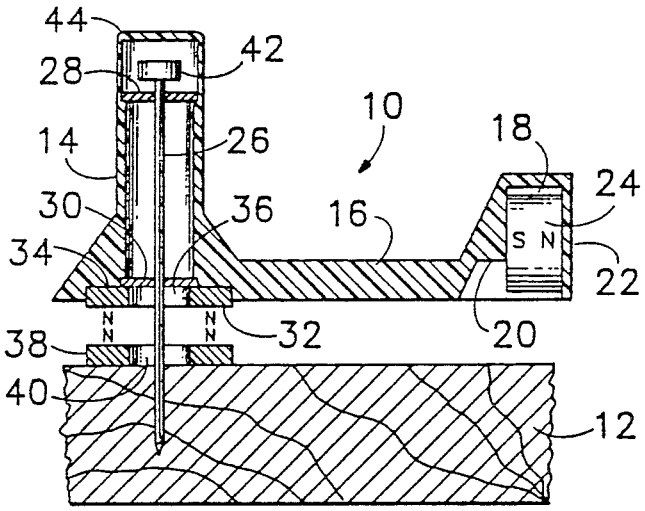
FIG. 2 is a fragmentary sectional view, on an enlarged scale, taken on the line 2—2 in FIG. 1.

Each spinner unit includes a central body axle 14 (FIG. 2) supporting a plurality of circumferentially spaced, radially extending arms 16. The axle and arms are of non-magnetic material, preferably of molded synthetic resin. The outer end of each arm is enlarged and formed as a hollow pocket 18 which is open on its underside. The inwardly extending wall of the pocket includes a wedge section 20 spaced inwardly from the thin, flexible outer wall 22 of the pocket. A permanent spinner magnet 24 is secured removably within the pocket 18 frictionally between the wedge and outer wall, by flexing of the outer wall.

An elongated pivot shaft 26 extends longitudinally through the body axle 14. It extends through outer bearing 28 and inner bearing 30 and is secured at its inner end to the support base 12. In the embodiment illustrated, the pivot shaft is provided with a sharply pointed inner end by with it penetrates the wooden support base 12 for attachment thereto.

A permanent levitator magnet 32 is secured in an inner recess 34 of the body axle 14 of the spinner unit, as by means of a film of glue or adhesive. The magnet is provided with a central opening 36 for the reception of the pivot shaft 26. A second permanent levitator magnet 38 is secured to the support base 12, as with a layer of glue or adhesive, in alignment with the levitator magnet 32. A central opening 40 through the levitator magnet 38 receives the pivot shaft 26 therethrough.

The levitator magnets 32 and 38 are arranged with like magnetic poles facing each other, as illustrated, whereby the mutual repulsion forces cause the magnets to be spaced apart. It is by this means that the spinner unit is supported a spaced distance away from the confronting surface of the support base 12, to eliminate frictional contact therebetween.

The pivot shaft 26 is provided with an enlarged head 42 at its outer end, outwardly of the outer bearing 28 to secure the spinner unit against outward removal from the pivot shaft.

The outer end of the body axle 14 is closed by a cap 44, and the support base 12 is provided with corner felt pads 46 of felt, sponge rubber or other suitable material for supporting the toy on a table or other support.

In the embodiment illustrated in FIG. 1, the magnets are positioned within the pockets so that their outer faces are the same polarity. Thus, in operation, let it be assumed that the right hand spinner unit is put into clockwise rotation, by manual activation. As the arm directed inwardly toward the left hand spinner unit rotates toward the inwardly directed arm of the left hand spinner unit, the like magnetic poles of the confronting spinner magnets cause the magnets to be repelled. This repulsion causes the inner magnet of the left hand unit to initiate counterclockwise rotation.

As the right hand spinner unit slows its speed of rotation, the left hand spinner unit also slows correspondingly. As some point in time the repulsion forces between the closely adjacent inwardly extending spinner magnets may cause the right hand spinner unit to reverse its direction of rotation to counterclockwise rotation, whereupon the next succeeding spinner magnet of the right hand unit may induce clockwise rotation of the left hand spinner unit. This concurrent rotation of the pair of spinner units in one direction or another continues for about one minute, and it affords the opportunity to a viewer to speculate as to how long a time the pair of spinner units will continue to rotate.

Figure 3:
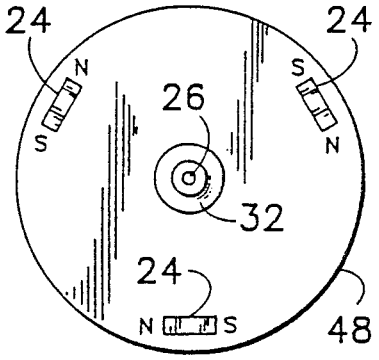
FIG. 3 is a schematic bottom plan view showing an alternative spinner body configuration and polarity arrangement of the magnets of spinner units.

In the embodiment illustrated in FIG. 3, the spinner body support arm component 48 is of circular configuration, as distinguished from the radially extending arms 16 of the previously described embodiment. A plurality of circumferentially spaced pockets are provided in the inner side of the circular support arm component for the containment of permanent spinner magnets 24. As illustrated, the circular support arm component supports three permanent spinner magnets 24 spaced apart circumferentially at 120° intervals.

FIG. 3 of the drawings also illustrates an alternative polarity configuration of the permanent spinner magnets of the adjacent spinner units. Thus, whereas in the previous embodiment the radially outward face of each spinner magnet is provided with the same polarity, in the embodiment of FIG. 3 the circumferentially facing surfaces of each spinner magnet is provided with the same polarity. The polarity configuration illustrated in FIG. 1 is preferred, however, since it provides a snappier action by virtue of generally transferring a higher percentage of energy when the spinner magnets interact.

Figure 4:
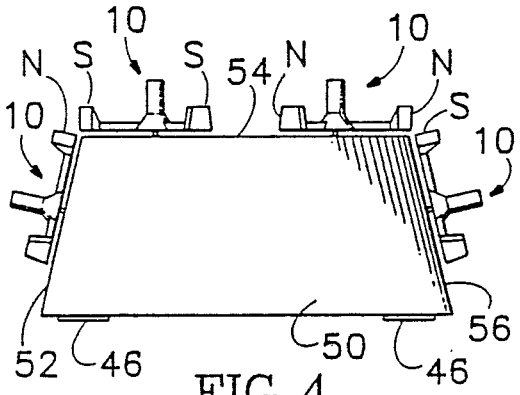
FIG. 4 is a side elevation showing an alternative configuration of the magnetic spinner toy assembly in which some of the spinner units are arranged to rotate on axes which are disposed angularly relative to each other.

FIG. 4 of the drawings illustrates a configuration in which the support base 50 is provided with a plurality of adjacent outer surfaces 52, 54 and 58 disposed angularly relative to each other, at angles somewhat greater than 90°. Each of the adjacent surfaces may support one or more spinner units 10 of the type previously described, with the permanent spinner magnets 24 of adjacent spinner units being disposed to move closely adjacent each other during their rotation.

FIG. 4 also illustrates an arrangement of spinner magnets 24 in which the outwardly facing surface of the spinner magnets of one of the spinner units is of opposite magnetic polarity to the outwardly facing surface of the spinner magnets of the adjacent spinner unit. Thus, whereas in FIG. 1 the rotation of one spinner unit initiates rotation of the adjacent unit by pushing the latter by magnetic repulsion forces, in FIG. 4 the rotation of one spinner unit initiates rotation of the adjacent unit by pulling the latter by magnetic attraction forces. To illustrate the operation of the embodiment of FIG. 4, the spinner unit on the right hand surface 56 of the support base 50 may be put into rotation manually. As this spinner unit is caused to rotate, it induces rotation of the spinner unit at the right side of the upper, horizontal surface 54 of the support base. Rotation of this spinner unit in turn effects rotation of the adjacent spinner unit at the left side of the upper, horizontal surface of the support base, and so on until all of the spinner units illustrated are put into rotation.

Figure 5:
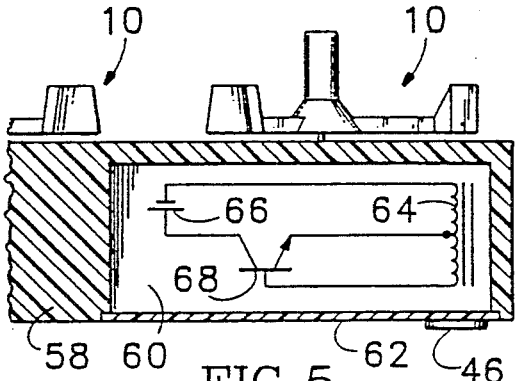
FIG. 5 is a fragmentary vertical sectional view showing an electromagnetic power drive circuit for rotating one of the spinner units of the assembly.

Referring now to FIG. 5 of the drawings, the support base 58 is shown to be provided with an inner compartment 60 which is closed removably by the closure plate 62. Within the compartment there is mounted an induction coil 64, preferably of the iron core, electromagnet type. The opposite ends of the coil are connected across a source of direct current electric potential, for example one or more conventional dry cells 66, through a control switch. As in the manner of U.S. Pat. No. 3,783,550 the control switch comprises a transistor 68. The base of the transistor is connected to one end of the coil 64, the collector is connected to the positive terminal of the battery 66 and the negative terminal of the battery is connected to the opposite end of the coil 64. The emitter is connected to an intermediate winding of the coil.

The operation of the embodiment of FIG. 5 is as follows:

The spinner unit 10 located above the coil 64 is put into rotation manually. The moving magnetic lines of force provided by the spinner magnets of the spinner unit cuts the turns of the coil and thus induces a current in the coil. The current flow through the base emitter of the transistor switch causes the transistor to turn on momentarily to connect the battery 66 across the coil. A pulse of battery current thus is applied momentarily through the coil, whereupon the latter produces a magnetic field which is imposed upon the spinner magnet 24 in the proximity of the coil. When this magnetic field is of the same polarity as the confronting face of the permanent spinner magnet 24, the repulsion force results in accelerating the spin of the spinner unit.

Thus, the electromagnet circuit of FIG. 5 provides a source of drive power for rotating the spinner unit immediately adjacent. That spinner unit, in turn, causes rotation of the spinner unit adjacent to it. It will be understood that any number of closely adjacent spinner units may be associated therewith, all rotated by the driving force provided by the powered spinner unit associated with the electromagnet drive circuit.

If desired, one or more additional spinner units may have an electromagnet drive circuit associated therewith for powering the spinner unit for an extended period of time.

It will be apparent to those skilled in the art that various other changes may be made in the size, shape, type, number and arrangement of parts described hereinbefore, without departing from the spirit of this invention and the scope of the appended claims.

We claim:

1. A magnetic spinner toy, comprising:

a) a support base, b) a plurality of spinner bodies of non-magnetic material each including a body axle member and a magnet support arm member extending radially outward from the body axle member, c) a plurality of permanent spinner magnets mounted on the support arm member of each body in circumferentially spaced apart relation radially outward of the axis of rotation of the body axle member, the magnetic poles of all spinner magnets on each spinner body being of identical orientation, d) pivot means on the axis of the body axle member of each spinner body mounting the plurality of bodies on the support base for free spinning rotation in laterally spaced apart arrangement with the circumferential rotation planes of the spinner magnets on the support arm members of the plurality of bodies positioned closely adjacent to each other, the spinner bodies projecting from the base and exposed for hand manipulation for initiating spinning rotation of any of said spinner bodies, e) the magnetic poles on the confronting faces of the spinner magnets of adjacent spinner bodies providing magnetic repulsion or attraction therebetween for rotation of the spinner bodies freely through random revolutions in one direction or the other.

2. The magnetic spinner toy of claim 1 wherein the magnet support arm member of each spinner body comprises a plurality of elongated arms projecting radially from the body axle member in circumferentially spaced positions, and a magnet pocket at the outer end of each arm containing one of said permanent spinner magnets.

3. The magnetic spinner toy of claim 1 wherein the magnet support arm member of each spinner body comprises a circular member extending concentrically about the body axle member, and a plurality of circumferentially spaced pockets adjacent the outer circumference of the circular member each contains one of said permanent spinner magnets.

4. The magnetic spinner toy of claim 1 wherein the support base includes a plurality of surfaces one disposed angularly relative to its adjacent surface, and the plurality of spinner bodies are mounted on the plurality of support base surfaces.

5. The magnetic spinner toy of claim 1 including an induction coil positioned adjacent the circumferential plane of rotation of the spinner magnets of at least one of the spinner bodies, and a battery-operated switching circuit is connected to the coil for energizing the coil momentarily as the lines of force of each spinner magnet cuts the turns of the coil.

6. In a magnetic spinner toy having a support base, a spinner body including a body axle member, and pivot means on the axis of the body axle member mounting the spinner body on the support base, a first permanent levitating magnet mounted on the support base concentric with the pivot means, and a second permanent levitating magnet mounted on the spinner body facing the support base, the confronting faces of the first and second permanent levitating magnets having like magnetic poles for repelling each other, whereby to space the spinner body from the support base, the pivot means comprising a pivot shaft extending freely through aligned openings in the levitating magnets and secured non-rotatably at one end to the support base, bearing means in the body axle member freely receiving the pivot shaft therethrough, and an enlarged retainer head on the end of the pivot shaft opposite said one end for preventing separation of the bearing means from the pivot shaft.

7. A magnetic spinner toy, comprising:

a) a support base, b) a plurality of spinner bodies of non-magnetic material each including a body axle member and a magnet support arm member extending radially outward from the body axle member, c) a plurality of permanent spinner magnets mounted on the support arm member of each body in circumferentially spaced apart relation radially outward of the axis of rotation of the body axle member, the magnetic poles of all spinner magnets on any one spinner body being of identical orientation, d) pivot means on the axis of the body axle member of each spinner body mounting the plurality of bodies on the support base in laterally spaced apart arrangement with the circumferential rotation planes of the spinner magnets on the support arm members of the plurality of bodies positioned closely adjacent to each other, the spinner bodies projecting from the base and exposed for hand manipulation, e) the magnetic poles on the confronting faces of the spinner magnets of adjacent spinner bodies providing magnetic repulsion or attraction therebetween for rotation of the spinner bodies freely through random revolutions in one direction or the other, f) a first permanent levitating magnet mounted on the support base concentric with the pivot means of each spinner body, and g) a second permanent levitating magnet mounted on each spinner body facing the support base, h) the confronting faces of the first and second permanent levitating magnets having like magnetic poles for repelling each other, whereby to space each spinner body from the support base, i) the pivot means comprising a pivot shaft extending freely through aligned openings in the levitating magnets and secured non-rotatably at one end to the support base, bearing means in the body axle member freely receiving the pivot shaft therethrough, and an enlarged retainer head on the end of the pivot shaft opposite said one end for preventing separation of the bearing means from the pivot shaft.

8. A magnetic spinner toy, comprising:

a) a support base, b) a plurality of spinner bodies of non-magnetic material each including a body axle member and a magnet support arm member extending radially outward from the body axle member, the magnet support arm member of each spinner body comprising a plurality of elongated arms projecting radially from the body axle member in circumferentially spaced positions, and a magnetic pocket at the outer end of each arm for containing a permanent spinner magnet, c) a plurality of permanent spinner magnets mounted on the support arm member of each body in circumferentially spaced apart relation radially outward of the axis of rotation of the body axle member, the radially outward surface of each of the spinner magnets of any one spinner body being of the same magnetic polarity, d) pivot means on the axis of the body axle member of each spinner body mounting the plurality of bodies on the support base in laterally spaced apart arrangement with the circumferential rotation planes of the spinner magnets on the support arm members of the plurality of bodies positioned closely adjacent to each other, the spinner bodies projecting from the base and exposed for hand manipulation, e) the magnetic poles on the confronting faces of the spinner magnets of adjacent spinner bodies providing magnetic repulsion or attraction therebetween for rotation of the spinner bodies freely through random revolutions in one direction or the other, f) a first permanent levitating magnet mounted on the support base concentric with the pivot means of each spinner body, g) and a second permanent levitating magnet mounted on each spinner body facing the support base, h) the confronting faces of the first and second permanent levitating magnets having like magnetic poles for repelling each other, whereby to space each spinner body from the support base, i) the pivot means comprising a pivot shaft extending freely through aligned openings in the levitating magnets and secured non-rotatably at one end to the support base, bearing means in the body axle member freely receiving the pivot shaft therethrough, and an enlarged retainer head on the end of the pivot shaft opposite said one end for preventing separation of the bearing means from the pivot shaft.

* * * * *